US008376286B2

(12) United States Patent
Anderson et al.

(10) Patent No.: US 8,376,286 B2
(45) Date of Patent: Feb. 19, 2013

(54) FOREIGN TRACK CURRENT SUPPRESSION SYSTEM AND METHOD

(75) Inventors: Larry J. Anderson, Blue Springs, MO (US); Forrest H. Ballinger, Grain Valley, MO (US)

(73) Assignee: General Electric Company, Schenectady, NY (US)

( * ) Notice: Subject to any disclaimer, the term of this patent is extended or adjusted under 35 U.S.C. 154(b) by 333 days.

(21) Appl. No.: 12/818,472

(22) Filed: Jun. 18, 2010

(65) Prior Publication Data

US 2011/0309205 A1 Dec. 22, 2011

(51) Int. Cl.
*B61L 1/12* (2006.01)
*H03F 1/00* (2006.01)

(52) U.S. Cl. .... 246/293; 246/34 A; 246/113; 246/122 R

(58) Field of Classification Search ..... 246/34 R, 246/34 A, 34 B, 34 CT, 111, 113, 114 R, 246/115, 117, 122 R, 208, 293, 473.1; 307/105; 375/346; 379/392.01, 416; 702/191
See application file for complete search history.

(56) References Cited

U.S. PATENT DOCUMENTS

| | | | | |
|---|---|---|---|---|
| 3,628,057 | A * | 12/1971 | Mueller | 307/105 |
| 4,066,229 | A * | 1/1978 | Clark | 246/34 CT |
| 4,417,229 | A | 11/1983 | Wilson | |
| 5,010,310 | A | 4/1991 | Frielinghaus | |
| 5,553,081 | A * | 9/1996 | Downey et al. | 714/709 |
| 5,903,615 | A * | 5/1999 | Thomson et al. | 375/346 |
| 5,966,684 | A * | 10/1999 | Richardson et al. | 702/191 |
| 6,498,820 | B1 * | 12/2002 | Thomson et al. | 375/346 |
| 6,785,532 | B1 * | 8/2004 | Rickard | 455/402 |
| 6,825,775 | B2 * | 11/2004 | Fling et al. | 340/856.3 |
| 8,149,967 | B2 * | 4/2012 | Umari et al. | 375/345 |
| 2008/0247537 | A1 * | 10/2008 | Henry et al. | 379/416 |
| 2012/0114114 | A1 * | 5/2012 | Samy | 379/392.01 |

FOREIGN PATENT DOCUMENTS

| | | | |
|---|---|---|---|
| DE | 2927104 | B1 | 4/1980 |
| EP | 0367730 | A2 | 5/1990 |
| GB | 826553 | A | 1/1960 |
| WO | 2009026971 | A1 | 3/2009 |

OTHER PUBLICATIONS

The WO Search Report issued in connection with corresponding International Application No. PCT/US2010/057731 on Feb. 14, 2011.

The WO Written Opinion issued in connection with corresponding International Application No. PCT/US2010/057731 on Feb. 14, 2011.

* cited by examiner

*Primary Examiner* — Mark Le
(74) *Attorney, Agent, or Firm* — GE Global Patent Operation; John A. Kramer

(57) ABSTRACT

There is provided a track current suppression device. An exemplary device includes an input coupled between rails of a railway track and configured to receive an input voltage corresponding to a track current. The exemplary device also includes an amplifier configured to receive the input voltage and generate a cancellation current. The exemplary device also includes an output coupled between the rails of the railway track and configured to deliver the cancellation current to the rails with reversed polarity compared to the track current.

14 Claims, 3 Drawing Sheets

100

300

FOREIGN TRACK CURRENT SUPPRESSION SYSTEM AND METHOD

BACKGROUND

Exemplary embodiments of the invention relate generally to a system and method for suppressing foreign current on railway tracks. Moreover, such exemplary embodiments may relate to suppressing foreign current that can interfere with the proper operation of train detection systems such as grade crossing control systems.

A grade crossing system is generally designed to warn motorists of the presence of an approaching train. Such systems often operate by transmitting and monitoring a discrete electrical current in the rails of the railway track. In many locations, high voltage power lines are routed parallel to, and in close proximity with railway tracks. For various reasons, including inductive coupling, power line energy can find its way onto the track in sufficient levels to interfere with the proper operation of the train detection equipment, especially grade crossing control equipment, causing unintended operation of the warning systems when no train is approaching the crossing.

Currently, either wide band shunts or heavy-duty narrow band shunts are applied between the rails of the track to load the offending current. However, wide band shunts can only be applied outside of the track circuit of the train detection equipment, because they load all frequencies more or less equally. Thus, wide band shunts may be ineffective if the source of the foreign current is close to the grade crossing. Further, when multiple crossings are adjacent to one another wide band shunts cannot be used at all. In some cases, narrow band shunts can have undesirable effects on the operation of the system they are intended to protect. Thus, a train detection system experiencing significant interference from foreign current may have to be replaced or redesigned to operate at a different frequency to avoid the effects of the foreign track current. Such redesigns may be expensive, and in high crossing density locations, the redesign may cause other undesirable results to adjacent crossings. Accordingly, an improved technique for mitigating foreign track current may be desirable.

BRIEF DESCRIPTION

Briefly, in accordance with an exemplary embodiment of the invention, there is provided a foreign track current suppression device. An exemplary device includes an input coupled between rails of a railway track and configured to receive an input voltage corresponding to a foreign track current. The exemplary device also includes an amplifier configured to receive and amplify the input voltage. The exemplary device also includes an output coupled between the rails of the railway track and configured to deliver the amplified voltage to the rails with reversed polarity compared to the track current.

Another exemplary embodiment relates to a grade crossing system. The grade crossing system includes a train detection system configured to deliver an electrical signal to rails of a railway track and monitor the signal to determine a presence of an approaching train. The grade crossing system also includes a warning device activated by the train detection system. The grade crossing system also includes a foreign track current suppression circuit. The foreign track current suppression circuit includes an input coupled between the rails and configured to receive an input voltage corresponding to a track current. The foreign track current suppression circuit also includes an amplifier configured to receive the input voltage and generate a cancellation current. The foreign track current suppression circuit also includes an output coupled between the rails of the railway track and configured to deliver the cancellation current to the rails with reversed polarity compared to the track current.

Yet another exemplary embodiment relates to a method of suppressing foreign current on a railway track. The exemplary method includes detecting an input voltage between rails of the railway track, the input voltage corresponding to a track current. The method also includes amplifying the input voltage to generate a cancellation current. The method also includes delivering the cancellation current to the rails with reverse polarity compared to the track current.

DRAWINGS

These and other features, aspects, and advantages of embodiments of the invention will become better understood when the following detailed description is read with reference to the accompanying drawings in which like characters represent like parts throughout the drawings, wherein.

DETAILED DESCRIPTION

Figure 1:
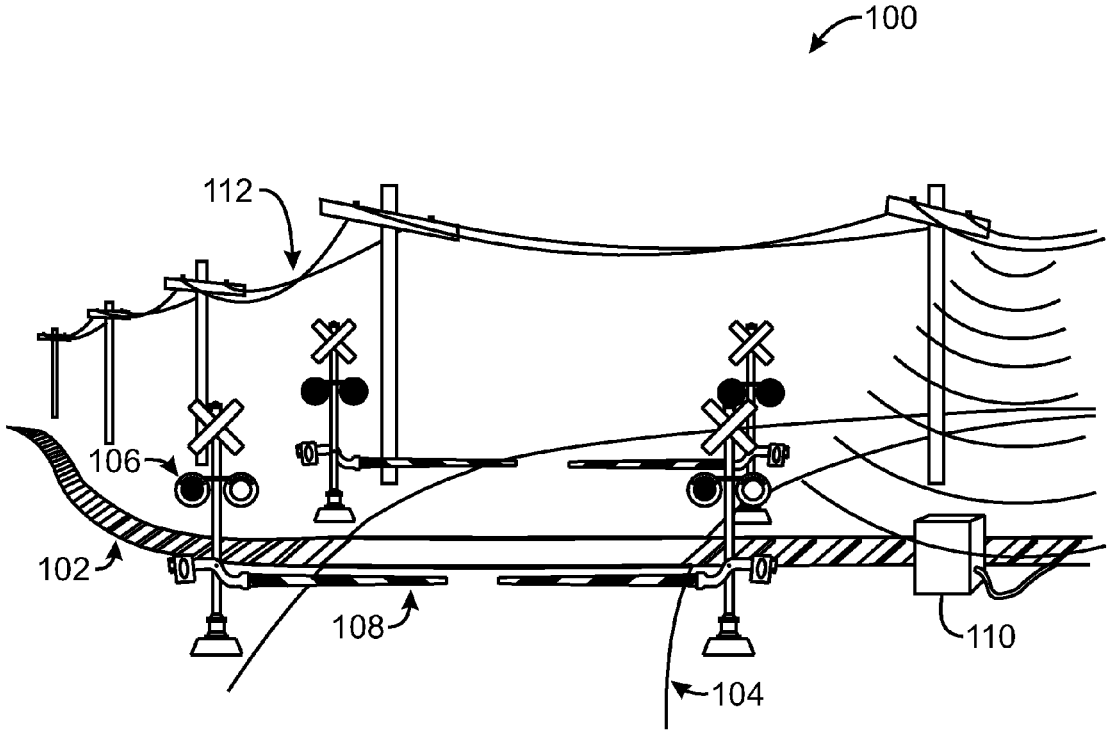
FIG. 1 is a perspective view of a grade crossing that may employ a foreign current suppression circuit, according to an exemplary embodiment of the invention.

FIG. 1 is a perspective view of a grade crossing system that may employ a foreign current suppression circuit, according to an exemplary embodiment of the invention. The grade crossing system is referred to by the reference number 100, and is deployed at a location where a railway track 102 crosses a roadway 104 at grade, in other words, at the same level as the roadway 104. The grade crossing system 100 may include a variety of warning devices for warning motorists or pedestrians of an approaching train, such as lights 106, gates 108, audio alarms, and the like. The grade crossing system 100 may also include a grade crossing control unit 110 configured to detect the presence of an approaching train and activate the warning devices. The control unit 110 may be contained within a housing near the crossing.

The railway track 102 and the grade crossing system 100 may be subjected to outside electrical interference, which may tend to induce a foreign current on the rails of the railway track. For example, as shown in FIG. 1, high power transmission lines 112 located near the railway track 102 generally produce electromagnetic radiation that can, in some cases, induce foreign current on the track 102. The foreign current induced on the track 102 may cause improper functioning of the grade crossing system, causing the warning devices to be activated when no train is approaching the crossing. Such foreign track current may be continuous due to the power lines 112 running parallel to the track 102 for a significant distance. Foreign track current may also be intermittent due to power line faults. Additional sources of foreign track current may also exist. In some embodiments, the control unit 110 may include a foreign current suppression circuit or device configured to reduce the level of foreign track current in the vicinity of the grade crossing system 100.

Figure 2:
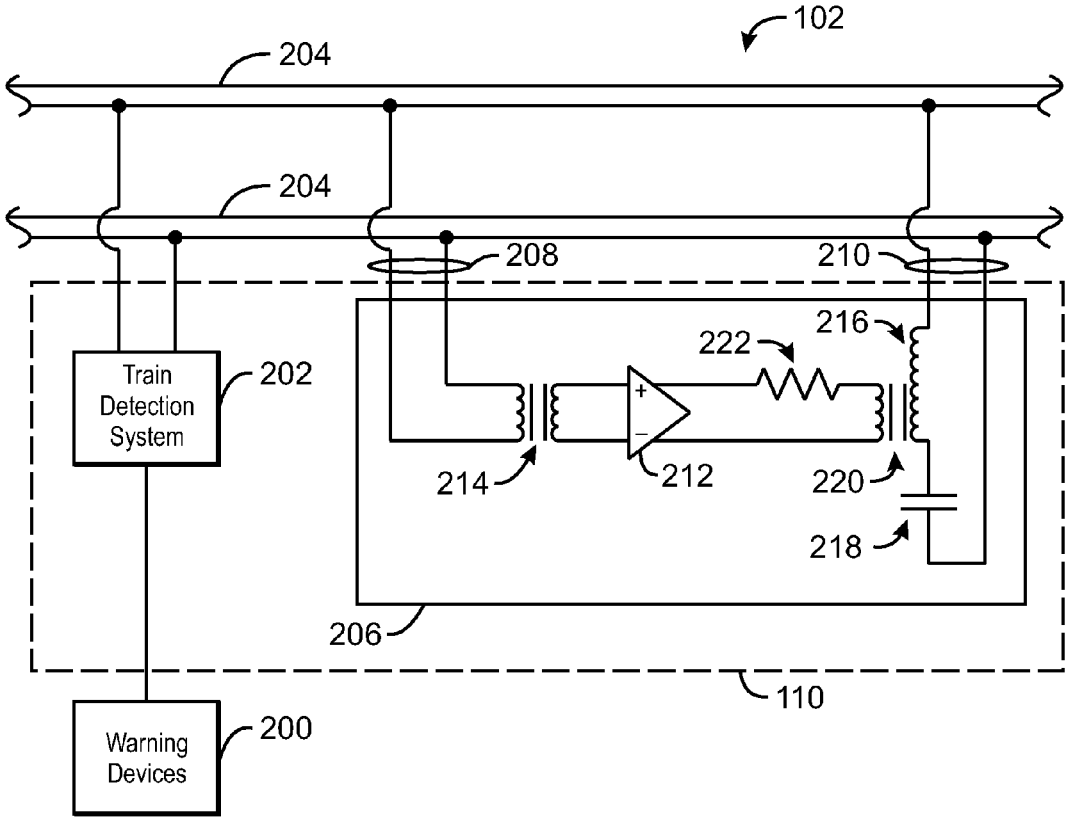
FIG. 2 is a block diagram of a grade crossing system that includes a foreign current suppression circuit, according to an exemplary embodiment of the invention.

FIG. 2 is a block diagram of a grade crossing system that includes a foreign current suppression circuit or device, according to an exemplary embodiment of the invention. As described above, the grade crossing system 100 may include a grade crossing control unit 110 operatively coupled to a variety of warning devices 200. As shown in FIG. 2, the control unit 110 may include a train detection system 202 coupled to the rails 204 of the railway track 102 and configured to identify the approach of a train. In some embodiments, the train detection system 202 operates by generating a dedicated detection signal, which is delivered to the rails 204 of the railway track 102 and monitored by the train detection system 202. A train approaching the grade crossing will cause variations in the detection signal. The train detection system 202 may monitor the magnitude and rate of change of the detection signal to identify the approach of a train and activate the warning devices 200. The track circuit used for the detection of trains approaching the grade crossing may be limited in length by a termination shunt, such as capacitive wide-band shunt, a tuned narrow-band shunt, or a simple wire shunt. A track circuit limit of the train detection system 202 may be determined based on the expected speed of the train and the amount of warning time desired for activation of the warning devices 200. For example, the track circuit limit may be approximately 1000 to 3000 feet (300 to 1000 meters). Conventional devices used for suppression of foreign track current, such as large wide band shunts, may be located outside of the track circuit limit to avoid excessive loading of the detection signal.

The grade crossing control unit may also include a foreign current suppression circuit or device 206 configured to suppress foreign track current in the vicinity of the train detection system 202. An input 208 of the foreign current suppression device 206 may be connected across the rails 204 of the track 102 to receive an input voltage signal corresponding to the foreign track current. An output 210 of the foreign current suppression device 206 may be connected across the rails 204 of the track 102 for delivering a cancellation current to the rails 204 that has a reversed polarity, or 180-degree phase shift, compared to the foreign track current. The foreign current suppression device 206 may be disposed within the track circuit limit of the train detection system 202 without significantly loading the detection signal generated by the train detection system 202. In some embodiments, the foreign current suppression device 206 may be disposed in close proximity to the train detection system 202. For example, disposing the foreign current suppression device 206 in close proximity to the train detection system 202 may include disposing the foreign current suppression device 206 within the same housing as the train detection system 202 or in a separate housing within the track circuit limit of the train detection system 202.

In some embodiments, the foreign current suppression circuit or device 206 includes an amplifier 212 coupled to the rails 204 and configured to amplify the voltage signal received from the rails 204 for generating the cancellation current. A first transformer 214 may be disposed between the rails 204 and the input of the amplifier 212 to provide electrical isolation between the amplifier 212 input and the rails 204.

In some embodiments, an LC circuit including an inductor 216 and a capacitor 218 may be coupled between the rails and series tuned to a frequency of interest. The frequency of interest may be a frequency at which foreign track current may be expected to occur or a frequency at which foreign track current has been detected. For example, the LC circuit may be tuned to 60 hertz or harmonics of 60 hertz to suppress foreign track current originating from a 60 hertz electrical transmission line. In an embodiment, the LC circuit is series tuned to a bandwidth centered at a frequency of approximately 60 hertz±3 hertz and having a bandwidth based on the total circuit quality factor, Q. By tuning the LC circuit to a frequency of interest, the loading of track circuit signals by the foreign current suppression circuit 206 may be reduced. In an embodiment, the output 210 may comprise the LC circuit, that is, the LC circuit is coupled between the rails and acts to deliver the cancellation current to the rails.

The foreign current suppression device 206 may also include a second transformer 220 disposed between the rails 204 and the output of the amplifier 212 to electrically isolate the amplifier 212 output from the rails 204. The output of the amplifier 212 may be coupled to an input winding of the transformer 220, and an output winding of the transformer 220 may be coupled to the rails 204. In some embodiments, the inductor 216 of the LC circuit discussed above may be the output winding of the transformer 220. A resistor 222 may also be connected in series between the output of the amplifier and the transformer 220 to reduce the effect of the amplifier on the primary inductance of the transformer 220. As shown in FIG. 2, the output of the amplifier 212 is electrically coupled to the rails 204 with reversed polarity so that the output voltage is 180 degrees out of phase with the input voltage. That is, for example, if one line of the input 208, attached to a first of the rails, constitutes a positive input of the amplifier 212, and a second line of the input 208, attached to a second of the rails, constitutes a negative input of the amplifier, then the positive output of the amplifier is (in effect) attached to the second rail, and the negative output of the amplifier is (in effect) attached to the first rail.

The inductance and capacitance values for the inductor 216 and capacitor 218 may be determined based on the frequency of interest and the desired bandwidth of the LC circuit, which may be determined by the ratio of the capacitive reactance, $X_C$, and inductive reactance, $X_L$, of the LC circuit. For example, given a target $X_C/X_L$ of between 10 and 15 Ohms and a frequency of interest of 60 hertz, the capacitor 218 may have a capacitance of approximately 180 to 280 microfarad and the inductor 216 may have an inductance of approximately 0.026 to 0.04 henrys. In some embodiments, the gain of the amplifier 212 may be adjusted to provide a total loop gain from input 208 to output 210 on the order of approximately 0.8 to 0.95. The total loop gain of the foreign current suppression circuit or device 206 will generally be somewhat less than 1.0 to avoid an oscillating feedback response. The amplifier 212 may operate at a fixed gain level, which may be factory adjusted to provide the desired total loop gain.

It will be appreciated that the foreign current suppression device 206 shown in FIG. 2 is but one example of a foreign current suppression device that could be used in accordance with embodiments of the invention. In some embodiments, the transformer 220 may also include a third winding (not shown) coupled to the input of the amplifier 212, in which case, the input 208 and the transformer 214 may be eliminated. In this embodiment, the input of the circuit or device 206 would comprise a connection to the third winding interacting with the LC circuit. In some embodiments, the input and/or output of the amplifier 212 may be coupled directly to the rails 204 and either of the transformers 214 and/or 220 may be eliminated. Other variations will occur to one of ordinary skill in the art with the benefit of the description contained herein.

The amplifier 212 and other components of the foreign current suppression device 206 may be selected to provide current to the track 102 sufficient to nullify the rail-to-rail voltage generated by the foreign track current. The relationship between track current and voltage depends on various factors, such as track impedance, which may vary from case to case. In an embodiment, the amplifier 212 is configured to be able to generate a continuous cancellation current of at least 3 amperes at 4 volts, for a total power capacity of at least 12 watts. In an embodiment, the amplifier is configured to be able to generate a continuous cancellation current of at least 8 amperes at 9 volts, for a total power capacity of at least 72 watts. The other components are configured to accommodate such power levels without damage. These power levels may be needed to suppress foreign track current, which may be of a magnitude to produce 4 to 9 volts between the rails 204 of the track 102.

Figure 3:
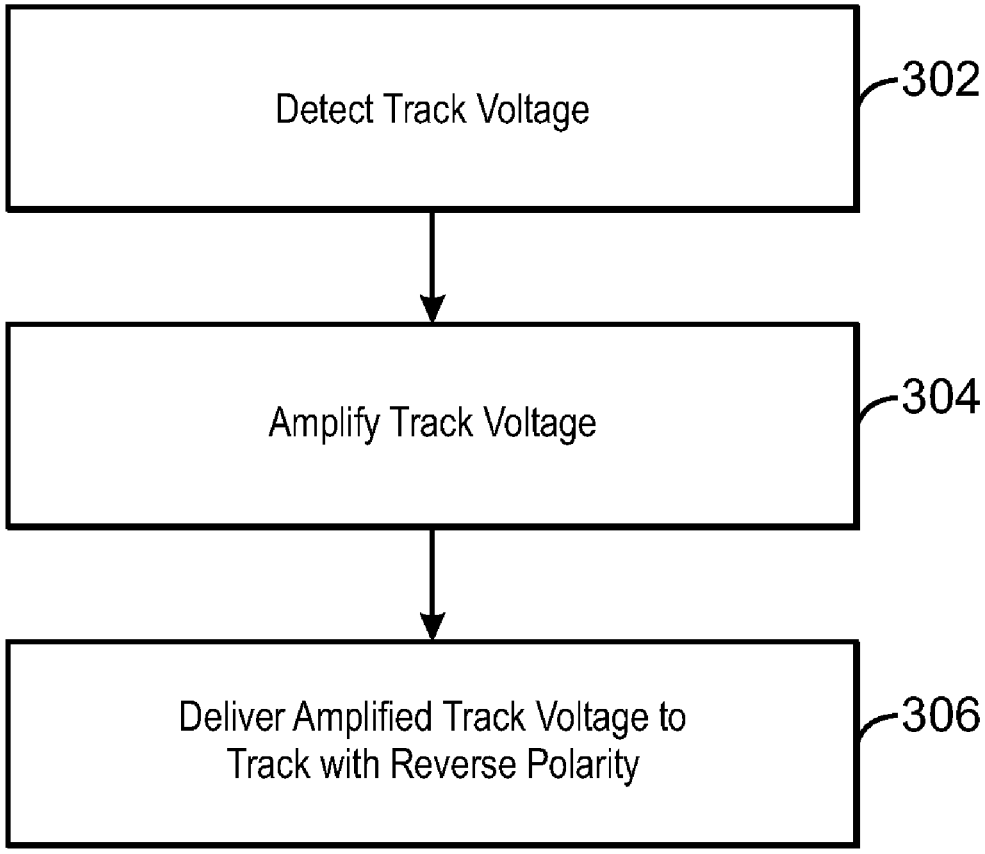
FIG. 3 is a process flow diagram showing a method of suppressing foreign current on a railway, according to an exemplary embodiment of the invention.

FIG. 3 is a method of suppressing foreign current on a railway, according to an exemplary embodiment of the invention. The method is referred to by the reference number 300 and may be begin at block 302. At block 302, the foreign track current may be detected by measuring an input voltage between rails of the railway track, the input voltage corresponding with the foreign track current. At block 304, the input voltage may be amplified to generate a cancellation current that is close in amplitude to the foreign track current. At block 306, the cancellation current may be delivered to the rails with reverse polarity, or 180 degrees out of phase, compared to the foreign track current indicated by the input voltage.

Experimental Results

A prototype of one embodiment of the invention was bench tested using a signal generator to simulate foreign track current. The signal generator had an output impedance of 50 ohms and was set to a frequency of 1340 hertz, which was the resonant frequency of the prototype LC circuit. The transformer 220 was a 36 mm A400 pot core with 357 turns of 28 gauge wire forming the output winding 216. The secondary winding of the transformer 220 had 18 turns of 28 gauge wire. The capacitor 218 was a 0.47 microfarad TH-type tantalum capacitor. The resistor 222 was a 10 Ohm ¼ Watt resistor. The amplifier 212 had an impedance of 8 Ohms and produced up to 1.8 Watts RMS.

An AC voltmeter was used to measure the current suppression level of the foreign current suppression device. The output voltage level of the signal generator measured by the voltmeter was −9.5 db prior to applying power to the amplifier 212. The measured voltage level rose to −4.5 db when power was applied to the amplifier 212. Incrementally increasing the gain of the amplifier 212 reduced the measured voltage to −30 db at maximum gain. The test results demonstrated the potential effectiveness of a foreign current suppression circuit implemented to reduce foreign current on a railway track.

An exemplary embodiment of the invention may provide several advantages. The reliability of grade crossing systems may be easily and inexpensively improved without replacing existing equipment and/or changing system operating frequencies in order to find a frequency less affected by the foreign current. The foreign current suppression system may also be used with other train detection equipment or track circuits, such as wayside signal circuits, and the like. The foreign current suppression device may be deployed within the track circuit limit of the train detection system, enabling the foreign current suppression device to be conveniently placed within the same housing and powered by the same power supply as the grade crossing system control unit.

Another embodiment relates to a track foreign current suppression device. The device comprises a first transformer, an amplifier, and an LC circuit. The first transformer is coupled between rails of a railway track, for receiving an input voltage corresponding to a track current. The amplifier has an input coupled to the first transformer, for receiving the input voltage from the first transformer. The amplifier is configured to generate a cancellation signal (e.g., a cancellation voltage signal) based on the input voltage. The cancellation signal has a reversed polarity compared to the track current. The LC circuit is disposed between the rails of the railway track and is operably connected to an output of the amplifier, for receiving the reversed polarity cancellation signal from the amplifier. The LC circuit is configured to generate a cancellation current proportional to the cancellation signal, and to deliver the cancellation current to the rails. For example, if the cancellation signal is a cancellation voltage signal, the voltage signal might induce the cancellation current in an inductor portion of the LC circuit, through an electro-magnetic coupling of the amplifier and LC circuit.

In another embodiment, the LC circuit comprises a capacitor and a second transformer connected to the capacitor in series. The output of the amplifier is coupled to a winding of the second transformer. The second transformer thereby electro-magnetically couples the amplifier to the LC circuit.

Another embodiment relates to a track foreign current suppression device. The device comprises an input, an amplifier, and an output. The input is coupled between rails of a railway track and is configured to receive an input voltage corresponding to a track current. The amplifier is configured to receive the input voltage and to generate a cancellation signal with reversed polarity compared to the track voltage. The output is coupled between the rails of the railway track and is configured to deliver a cancellation current to the rails, for at least partially suppressing the track voltage. The cancellation current is proportional to the cancellation signal. For example, in an embodiment, the output includes a transformer, which is coupled to an output of the amplifier. The cancellation signal output by the amplifier induces the cancellation current in the transformer.

Certain embodiments are illustrated as comprising an amplifier and an output, where the amplifier generates a (reversed polarity) cancellation current and the output delivers the cancellation current to the rails. As should be appreciated, the interface between the amplifier and the output may be direct (e.g., a direct electrical connection) or indirect. In the case of an indirect connection, the cancellation current generated by the amplifier may in effect produce a cancellation voltage signal, which induces a corresponding cancellation current in the output by way of an electro-magnetic coupling between the amplifier and output (such as through a transformer). Thus, when embodiments are characterized as the amplifier generating a cancellation current and the output delivering the cancellation current to the rails, this includes the possibility of slight variances between the amplifier output and the current delivered to the rails, "slight" meaning the same but for inductance losses (e.g., transformer inefficiencies) and losses due to line resistance, parasitic capacitances, and the like. Although, "delivering" the cancellation current to an LC circuit may include inducing the cancellation current in the LC circuit, based on a cancellation current output of the amplifier and corresponding voltage signal of the amplifier output.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions, values, and types of materials described herein are intended to illustrate embodiments of the invention, they are by no means limiting and are exemplary in nature. Other embodiments may be apparent upon reviewing the above description. The scope of the invention should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," "third," "upper," "lower," "bottom," "top," "up," "down," etc. are used merely as labels, and are not intended to impose numerical or positional requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

As used herein, an element or step recited in the singular and proceeded with the word "a" or "an" should be understood as not excluding plural of said elements or steps, unless such exclusion is explicitly stated. Furthermore, references to "one embodiment" of the invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described apparatus for securing an electronic device, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A track current suppression device, comprising:

an input coupled between rails of a railway track and configured to receive an input voltage corresponding to a track current;

an amplifier configured to receive the input voltage and generate a cancellation current;

a transformer coupled between the rails of the railway track and configured to deliver the cancellation current to the rails at a frequency of interest and with reversed polarity compared to the track current; and an LC circuit coupled between the rails and series tuned to the frequency of interest, the LC circuit operably coupled to the amplifier to receive the cancellation current from the amplifier, wherein an inductor of the LC circuit is an output winding of the transformer.

2. The track current suppression device recited in claim 1, wherein the LC circuit is series tuned to a center frequency of approximately 60 hertz.

3. The track current suppression device recited in claim 1, further comprising another transformer disposed between the rails and coupled to an input of the amplifier, for isolating the input of the amplifier from the rails.

4. The track current suppression device recited in claim 1, wherein the device is disposed inside a track circuit limit of a train detection system.

5. The track current suppression device recited in claim 1, wherein the device is disposed inside a housing of a grade crossing control unit.

6. A grade crossing system, comprising:

a train detection system configured to deliver an electrical signal to rails of a railway track and monitor the signal to determine a presence of an approaching train;

a warning device activated by the train detection system; and a track current suppression circuit comprising:

an input coupled between the rails and configured to receive an input voltage corresponding to a track current;

an amplifier configured to receive the input voltage and generate a cancellation current;

a transformer coupled between the rails of the railway track and configured to deliver the cancellation current to the rails at a frequency of interest and with reversed polarity compared to the track current; and an LC circuit coupled between the rails and series tuned to the frequency of interest, the LC circuit operably coupled to the amplifier to receive the cancellation current from the amplifier, wherein an inductor of the LC circuit is an output winding of the transformer.

7. The grade crossing system of claim 6, wherein the LC circuit is series tuned to a bandwidth centered at a frequency of approximately 60 hertz or harmonics of 60 Hertz.

8. The grade crossing system of claim 6, wherein the track current suppression circuit further comprises another transformer disposed between the rails and coupled to an input of the amplifier, for isolating the input of the amplifier from the rails.

9. The grade crossing system of claim 6, wherein the track current suppression circuit is disposed inside a track circuit limit of the train detection system.

10. The grade crossing system of claim 6, wherein the track current suppression circuit and the train detection system are disposed inside a common housing.

11. A track current suppression device, comprising:

an input coupled between rails of a railway track and configured to receive an input voltage corresponding to a track current;

an amplifier configured to receive the input voltage and generate a cancellation current; and an output coupled between the rails of the railway track and configured to deliver the cancellation current to the rails with reversed polarity compared to the track current, wherein a total loop gain of the device is approximately 0.8 to 0.95.

12. A track current suppression device, comprising:

a first transformer coupled between rails of a railway track for receiving an input voltage corresponding to a track current;

an amplifier having an input coupled to the first transformer, for receiving the input voltage from the first transformer, wherein the amplifier is configured to generate a cancellation signal based on the input voltage, wherein the cancellation signal has a reversed polarity compared to the track current; and an LC circuit disposed between the rails of the railway track and operably connected to an output of the amplifier for receiving the reversed polarity cancellation signal from the amplifier, wherein the LC circuit is configured to generate a cancellation current proportional to the cancellation signal and to deliver the cancellation current to the rails;

wherein the LC circuit comprises a capacitor and a second transformer connected to the capacitor in series, wherein the output of the amplifier is coupled to a winding of the second transformer.

13. A grade crossing system, comprising:

a train detection system configured to deliver an electrical signal to rails of a railway track and monitor the signal to determine a presence of an approaching train;

a warning device activated by the train detection system; and a track current suppression circuit comprising:

an input coupled between the rails and configured to receive an input voltage corresponding to a track current;

an amplifier configured to receive the input voltage and generate a cancellation current; and an output coupled between the rails of the railway track and configured to deliver the cancellation current to the rails with reversed polarity compared to the track current, wherein a total loop gain of the track current suppression circuit is approximately 0.8 to 0.95.

14. A method of suppressing foreign current on a railway track, the method comprising:

detecting an input voltage between rails of the railway track, the input voltage corresponding to a track current;

amplifying the input voltage to generate a cancellation current; and delivering the cancellation current to an input winding of a transformer coupled between the rails with reverse polarity compared to the track current, wherein an output winding of the transformer is series coupled to a capacitor to form an LC circuit that is tuned to a frequency to be canceled.

* * * * *